US005181076A

United States Patent [19]

Nishikawa

[11] Patent Number: 5,181,076

[45] Date of Patent: Jan. 19, 1993

[54] JAM PREVENTION MECHANISM

[75] Inventor: Tomoyuki Nishikawa, Matsudo, Japan

[73] Assignee: Asahi Kogaku Kogyo Kabushiki Kaisha, Tokyo, Japan

[21] Appl. No.: 664,673

[22] Filed: Mar. 5, 1991

[30] Foreign Application Priority Data

Mar. 6, 1990 [JP] Japan ..... 2-54163

[51] Int. Cl.[5] ..... G03G 15/70

[52] U.S. Cl. ..... 355/315; 355/290; 271/311; 271/900

[58] Field of Search ..... 355/290, 315; 271/306, 271/307, 311, 900

[56] References Cited

U.S. PATENT DOCUMENTS 4,423,951 1/1984 Rightmyre .
4,640,600 2/1987 Hirabayashi et al. .
4,755,848 7/1988 Tamary ..... 355/315

FOREIGN PATENT DOCUMENTS 63-281183 11/1988 Japan ..... 355/315
1-94373 4/1989 Japan ..... 271/307
2-190886 7/1990 Japan ..... 355/315
2024173 1/1980 United Kingdom .
2170831 8/1986 United Kingdom .

*Primary Examiner*—Joan H. Pendegrass
*Attorney, Agent, or Firm*—Sandler, Greenblum & Bernstein

[57] ABSTRACT

A jam prevention mechanism is provided, adapted to be positioned in a device including a pair of rollers through which a sheet is to be fed, for preventing the sheet from being caught around one of the pair of rollers. The jam prevention mechanism comprises at least one contact member arranged to be located at the downstream side of the pair of rollers along a sheet feeding direction, and contacted with a circumferential surface of one of the pair of rollers by a predetermined force. The contact member is further arranged so as not to be moved along the sheet feeding direction. Thus, the recording sheet can be prevented from being caught around the roller without an excessive resistance applied against the rotation of the roller, and jamming of the recording sheet can be prevented before it happens.

13 Claims, 6 Drawing Sheets

JAM PREVENTION MECHANISM

BACKGROUND OF THE INVENTION

The present invention relates to a jam prevention mechanism for a heat roll fixing unit used in an image formation device, such as a printer, employing so called electrophotographic system, and more particularly to a jam prevention mechanism for preventing a recording sheet, on which a visible image has been formed, from being caught around a heat roller in a sheet discharge process after the recording sheet has been fixed, by which jam is caused.

Conventionally, there has been known a copy machine and a printer as an image formation device using so-called electrophotographic system, wherein a latent image is formed by exposing a photoreceptor on the surface of a photoconductive drum, adhering toner to the latent image to change the latent image to a visible image, and then transferring the toner image to a recording sheet and fixing the transferred image by a fixing unit.

In this type of image formation device using the electrophotographic system, a so-called heat roll fixing method is used, by which an unfixed visible image on the recording sheet is pressed against a heat roller, i.e., a heat roller, and toner is heated and fusedly adhered by the heat applied from the roller.

To effect the heat roll fixing, a pair of fixing rollers are composed of a heat roller heated to high temperatures and a press roller, which are disposed in parallel to each other with the recording sheet held therebetween to cause the recording sheet to be pressed against the heat roller for heating; the heat roll fixing is advantageous in that the fixing can be carried out at a high speed with a high thermal efficiency. Usually, the heat roller is driven by a driving source and the press roller is arranged to be rotated with the heat roller, and the recording sheet is fed through a gap generated between the pair of fixing rollers.

Incidentally, a guide member is adjacently disposed at the sheet discharge side of the above-mentioned heat roll fixing unit with the pair of fixing rollers so that the recording sheet is separated from the heat roller after the fixing operation and guided along the desired feeding path. Accordingly, the recording sheet is prevented from being caught around the heat roller, and being jammed.

A gap between the guide member and the rollers is preferably minimized in view of the function thereof. In other words, it is preferable to separate the recording sheet from the heat roller immediately after the fixing operation is finished.

Thus, a claw-shaped separation member is often provided at the extreme end of the roller side of the guide member and the separation member is urged against the roller by a predetermined pressing force. Further, the separation member may be composed of an elastic material so that the separation member is pressed against the roller by the returning force thereof after the separation member has been deformed. Note that the larger the pressing force applied to the roller by the separation member, the more effectively the recording sheet is prevented from being caught around the roller.

However, in the arrangement in which the press roller is arranged to be rotated with the driven heat roller as described above, a problem arises in that the pressed separation member resists the rotation of the press roller arranged to be rotated with the heat roller, with the result that the recording sheet is poorly fed and the visible image is poorly fixed.

To cope with this problem, when the pressing force of the separation member toward the press roller is reduced, the effect to separate the recording sheet, i.e., the effect to prevent the recording sheet from being caught around the roller is deteriorated, and thus it is very difficult to set a pressing force of the separation member to such a state, wherein the pressing force does not resist the rotation of the press roller and sufficiently prevents the recording sheet from being caught.

SUMMARY OF THE INVENTION

It is therefore an object of the invention to provide an improved jam prevention mechanism which can prevent a recording sheet from being caught around a roller without applying an excessive resistance against the rotation of a press roller, whereby an insufficient feed, poor fixing and jam caused by the winding of the recording sheet can be eliminated.

For this purpose, according to the present invention, there is provided a jam prevention mechanism, adapted to be positioned in a device including a pair of rollers through which a sheet is to be fed, for preventing the sheet from being caught around one of the pair of rollers, the jam prevention mechanism comprises.

at least one contact member arranged to be located at the downstream side of the pair of rollers along a sheet feeding direction, and contacted with a circumferential surface of one of the pair of rollers by a predetermined force, the contact member being further arranged so as not to be moved along the sheet feeding direction.

DESCRIPTION OF THE ACCOMPANYING DRAWINGS

DESCRIPTION OF THE EMBODIMENTS

Figure 1:
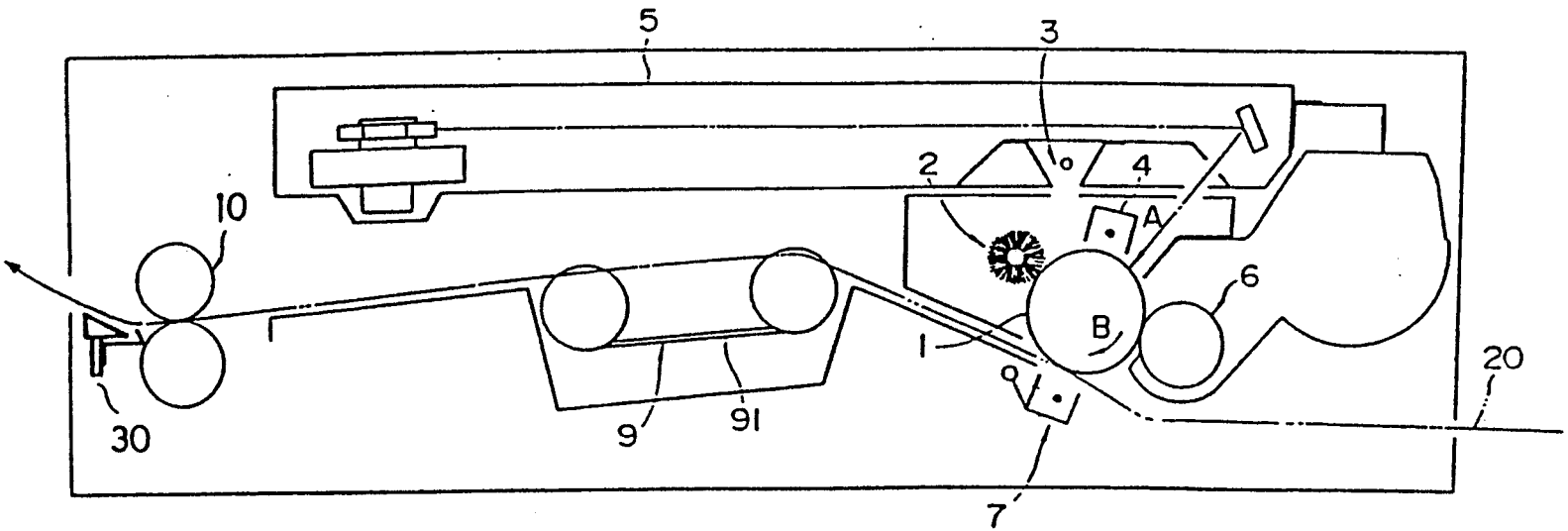
FIG. 1 shows a side view of an electrophotographic printer employing a jam prevention mechanism according to the present invention.

FIG. 1 shows a laser beam printer, using a continuous-form fan-folded sheet as a recording sheet, by which character information inputted from a computer and the like, not shown, are printed on the continuous-form sheet 20 by a so-called electrophotographic system.

Figure 2:
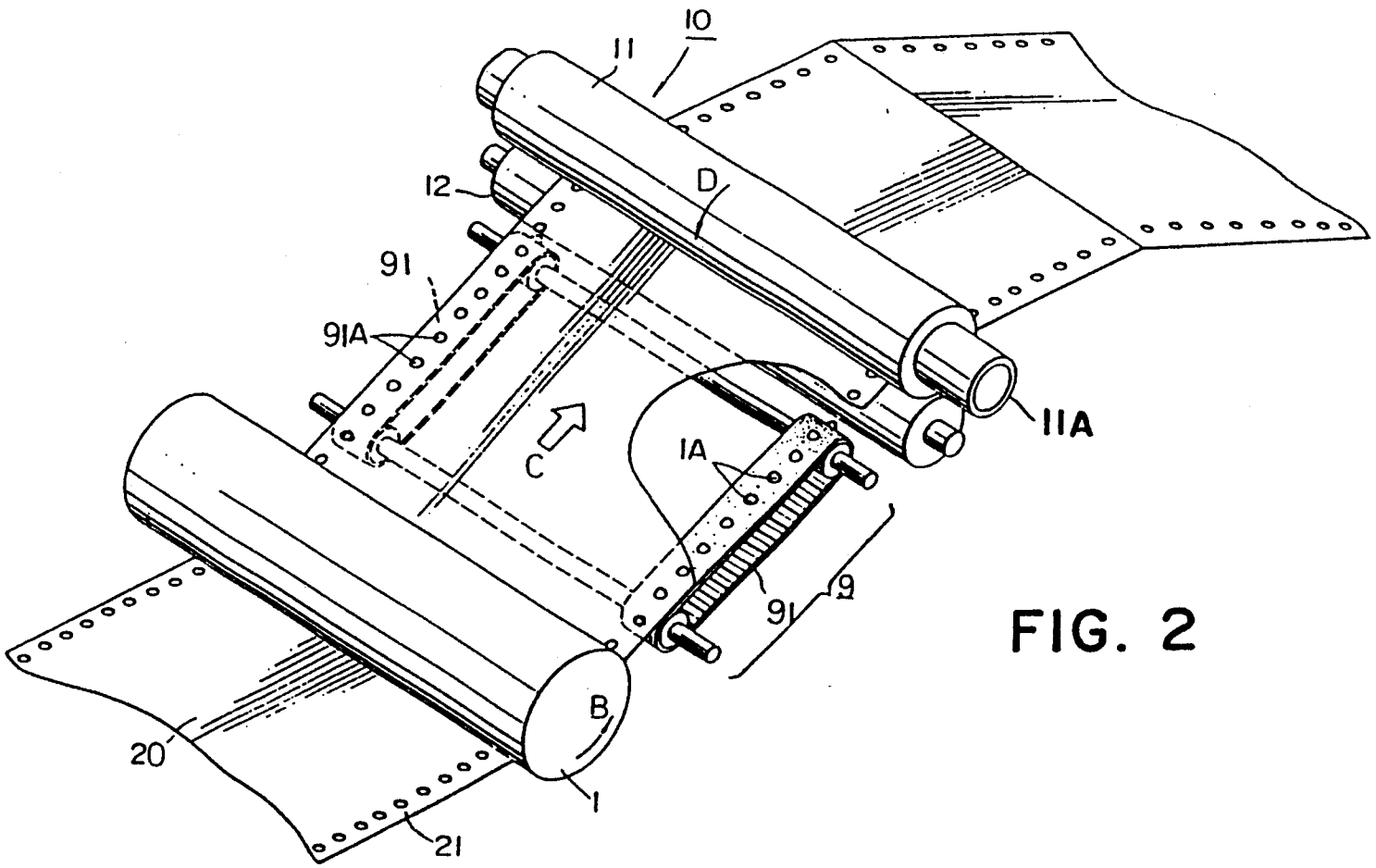
FIG. 2 shows a perspective view showing a relationship among a photoconductive drum, a tractor, and a fixing unit including a pair of rollers, respectively employed in the printer shown in FIG. 1.

A toner cleaning unit 2, a discharging unit 3, a charging unit 4, a scanning optical system 5 for introducing a laser beam to a photoconductive drum 1 as indicated by an arrow "A", a development unit 6, and a transfer unit 7 are disposed, respectively, around the photoconductive drum 1 in the rotating direction thereof indicated by an arrow "B". Further, a fixing unit 10 is disposed at the downstream side of the photoconductive drum 1, and a tractor 9 through which the continuous-form sheet 20 is fed toward the fixing unit 10 is disposed as shown in FIG. 1. The tractor 9 includes a pair of tractor belts 91, 91 each having a plurality of projections 91A arranged to be fitted into a plurality of sprocket holes 21 provided on both side edges of the continuous-form sheet 20, as shown in FIG. 2. The continuous-form sheet 20, having been fed through the photoconductive drum 1, is fed by the tractor 9 as indicated by an arrow "C".

In this above-described laser beam printer, a circumferential surface of the photoconductive drum 1 is charged at the charging unit 4, and as the photoconductive drum 1 is rotated in the "B" direction, the surface thereof is scanned by the laser beam from the scanning optical system 5, having been modulated by image information to be developed to form an electrostatic latent image. Toner is then adhered to the latent image at the development unit 6 to form a visible image corresponding to the latent image, and the toner image is transferred onto the continuous-form sheet 20 at the transfer unit 7 and fixed at the fixing unit 10.

As shown in FIG. 2, the fixing unit 10 comprises a pair of rollers, respectively supported by shafts, not shown, provided on a chassis of the laser beam printer, comprising a heat roller 11 to be heated up to a predetermined temperature by means of a heating element 11A, such as a halogen lamp contained within a cylindrical body thereof, and a press roller 12 arranged to be brought into and out of contact with each other. The lower press roller 12 is a rubber lining roller whose circumferential surface is lined by silicon rubber or the like having a predetermined hardness and a predetermined thickness, and is pressed against the heat roller 11 by a not shown spring. The heat roller 11 is arranged to be rotated by a not shown drive source, such as a motor, along a direction indicated by an arrow "D"and the press roller 12 is arranged to be rotated with the heat roller 11 by means of a not shown transmission mechanism. In a contacted state, a predetermined pressure force is generated between the pair of rollers and the continuous-from sheet 20 which is fed along the "C"direction and pressed thereby.

Referring to FIGS. 3 through 6, an arrangement and an operation of the jam prevention mechanism according to the present invention will be described hereinafter.

Figure 3:
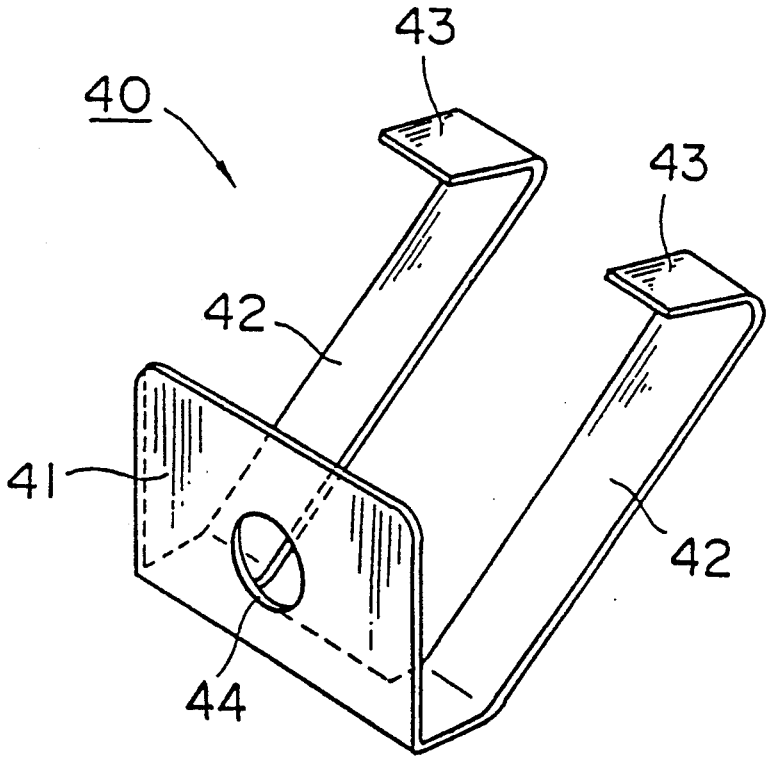
FIG. 3 shows a perspective view of a guide spring employed in the jam prevention mechanism according to the present invention.
Figure 4:
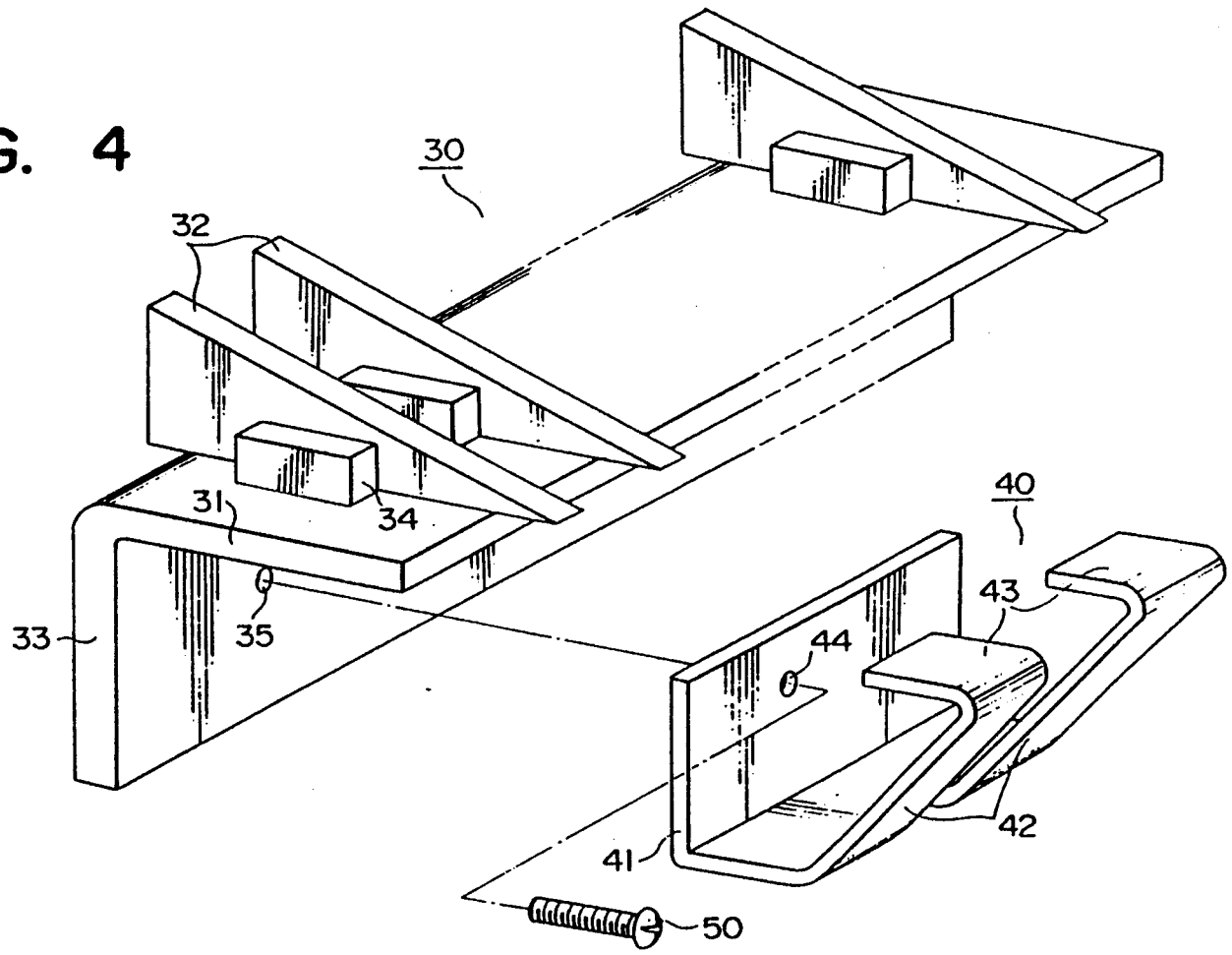
FIG. 4 shows a perspective view of a guide member employed in the jam prevention mechanism according to the present invention.

FIG. 3 shows a perspective view of a guide spring 40 employed in the jam prevention mechanism, and FIG. 4 shows a prespective view of a sheet discharge guide 30 to which the guide spring shown in FIG. 3 is fixed. The sheet discarge guide 30 is disposed at the downstream side of the fixing unit 10. The sheet discharge guide 30 comprises a plurality of triangular ribs 32, along which the continuous-form sheet 20 is to be fed, standing in parallel on an upper surface of a base 31.

As shown in the perspective view of FIG. 3, the guide spring 40 comprises a pair of pressing portions 42, 42 obliquely extending along the opposite sides of a mounting portion 41 thereof. The extreme ends of the pressing portions 42, 42 are bent toward the mounting portion 41 at an acute angle to form bent portions 43, 43.

Figure 5:
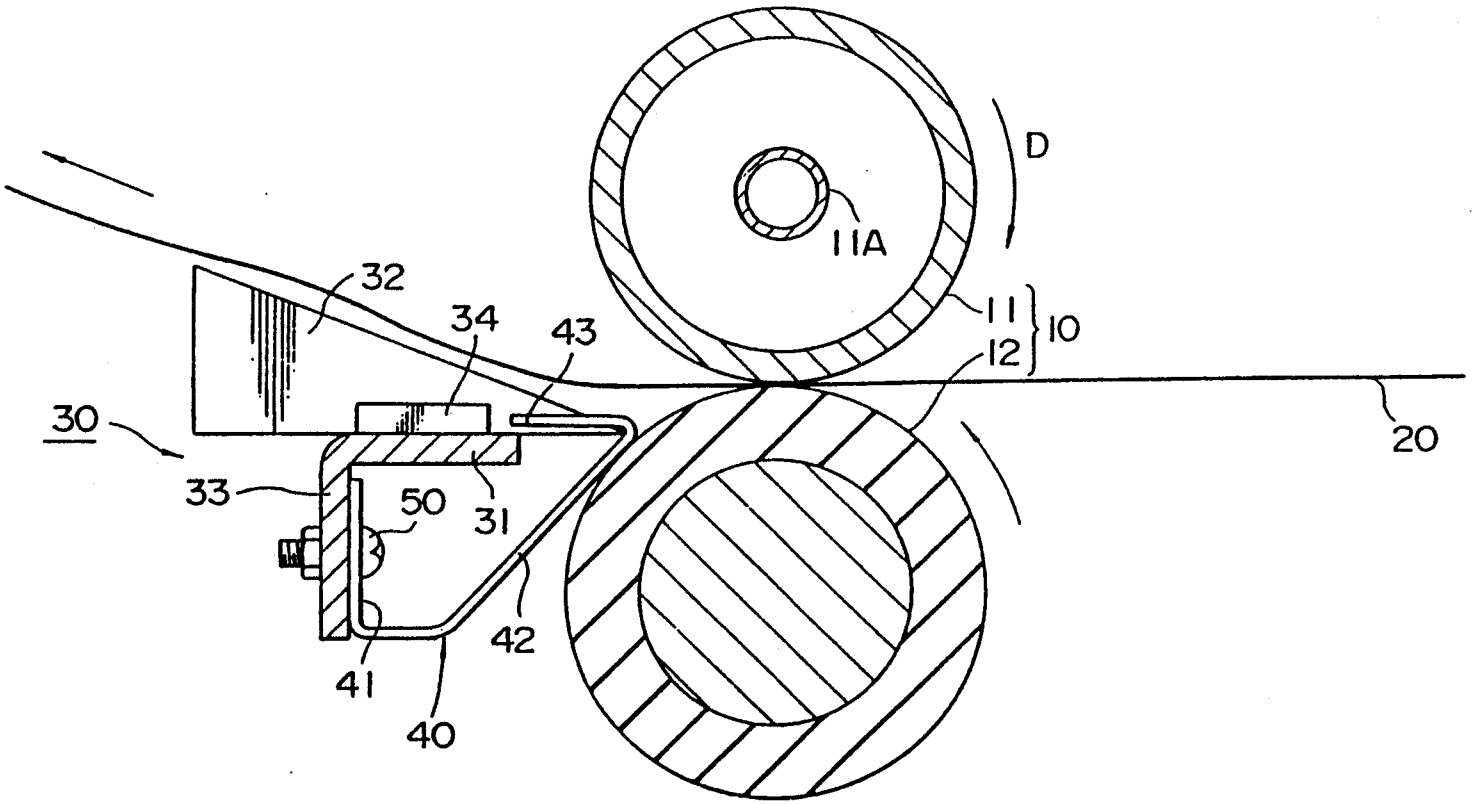
FIGS. 5 and 6 respectively show side views of the operating jam prevention mechanism according to the present invention.

When the mounting portion 41 is attached to the mounting portion 33 of the sheet discharge guide 30 by means of a predetermined member such as screw 50, arranged to be inserted into through holes 44 and 35 respectively formed on the mounting portions 41 and 33, the extreme ends of the pressing portions 42, 42 are heldin abutment against the press roller 12 as shown in FIG. 5 and are elastically deformed and thus pressed against the surface of the press roller 12 at a predetermined pressing pressure, i.e., elastic returning force. The portions 43 are also arranged to be made parallel to the upper surface of the base 31. Further, the extreme edge of the rib 32 which is placed at the most outside postion on the base 31 is located between the bent potions 43, 43. In the drawing of FIG. 4, one guide spring 40 is only represented, however, it is possible to provide a plurality of guide springs 40 along a width direction of the continuous-form sheet 20, for example, at both side edge portions of the width of the sheet.

A weak force is set as the pressing force applied to the press roller 12 by the pressing portions 42 of the guide spring 40, so that an excessive resistance is not applied against the rotation of the press roller 12.

Further, a pair of stoppers 34, 34 are projectingly disposed on the upper surface of the base 31 of the sheet discharge guide 30 at positions on extending lines of the bent portions 43, 43 of the guide spring 40 and spaced apart from the extreme ends thereof by a predetermined interval in the direction opposiite to the press roller 12.

With the fixing unit arranged as described above, the press roller 12 is rotated as the heat roller 11 is driven, and the continuous-form sheet 20 having unfixed toner placed thereon is held between the rollers 11 and 12 and heated by the heat roller 11 with a feeding operation, and finally discharged.

When the fixing operation is carried out in the above-described manner, the extreme ends of the pressing portions 42, 42 of the guide spring 40 are held in abutment and urged against the press roller 12 by the deforming returm force thereof, so that the continuous-form sheet 20 to be discharged is prevented from entering between the press roller 12 and the sheet discharge guide 30 during rotation of the press roller 12.

Figure 6:
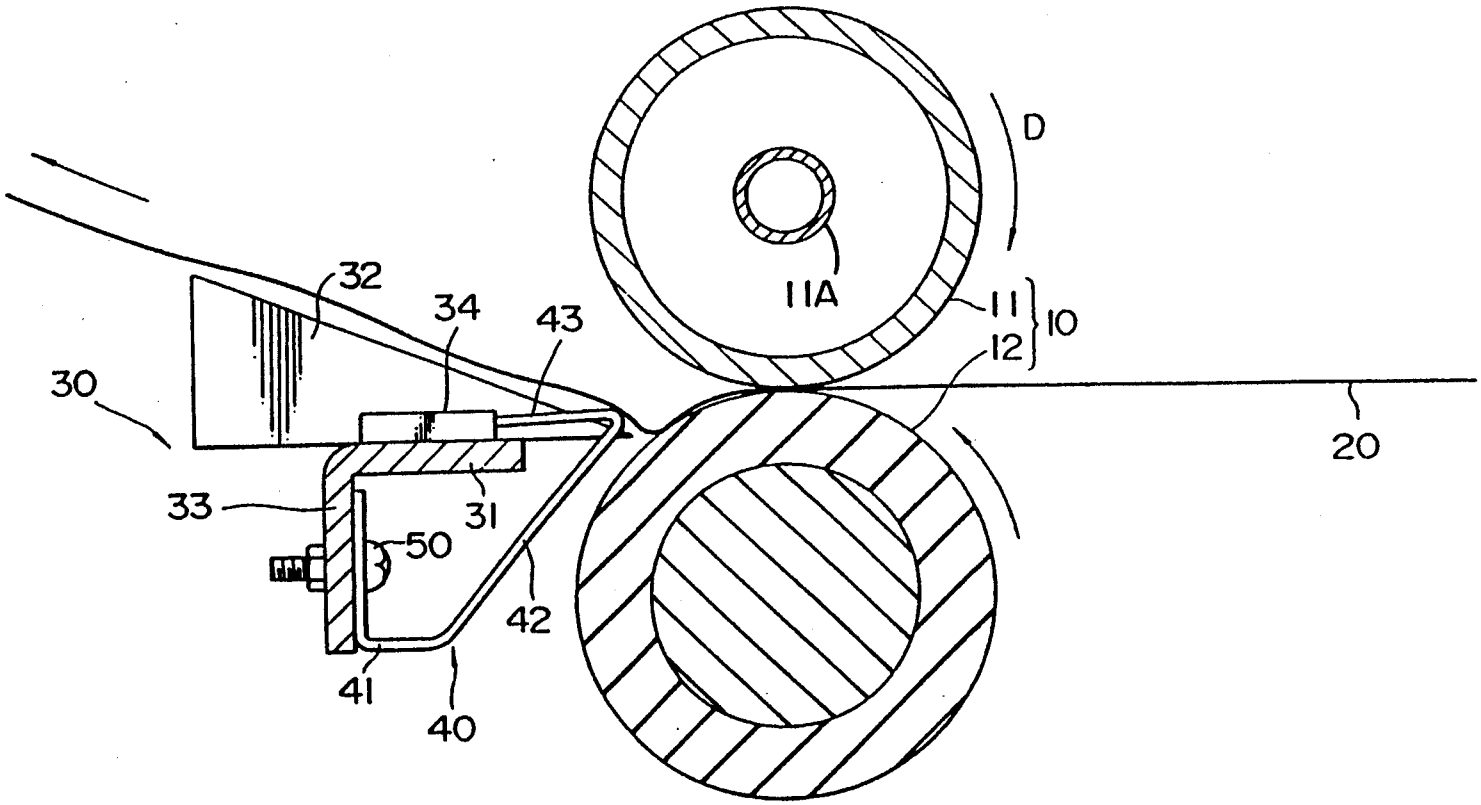

The pressing protions 42, 42 of the guide spring 40 are arranged to press the press roller by the weak force as described above, and thus when the continuous-form sheet 20 abuts against the pressing portions 42, 42 and by some reasons, such as that the perforated tear line of the continuous-form sheet 20 is caught by the extreme ends of the pressing portions 42, 42, the pressing portions 42, 42 of the guide spring 40 may be pressed in the sheet feeding direction. In this case, although the extreme ends 42, 42 are moved in the sheet feeding direction, the movement is prevented by the extreme ends of the bent portions 43 of the guide spring 40 abutted against the stoppers 34, 34 of the sheet discharge guide 30, as shown in FIG. 6.

In other words, when a gap between the extreme ends of the bent portions 43 of the guide spring 40 and the stopper 34 is suitably set, a gap between the extreme ends of the pressing portions 42, 42 of the guide spring 40 and the surface of the press roller 12 is not increased more than a predetermined distance, even if an unexpected force should be applied to the pressing portions 42, 42. As a result, the continuous-form sheet 20 can be easily prevented from being caught through the gap and thus jams caused thereby can be prevented. Further, if the continuous-form sheet 20 should be caught through the gap, a lot of the continuous-form sheet 20 is not caught and no serious jam is caused. That is the gap between the press roller 12 and the pressing portions 42, 42 of the guide spring 40 can be arranged so as not to be increased more that the predetermined distance and the pressing force applied by the extreme ends of the pressing portions 42, 42 of the guide spring 40 is set to such a small value which does not act as a resistance against the rotation of the press roller 12. In other words, both the reduction of the resistance against the rotation of the press roller 12 and the prevention of the recording sheet from being caught around the roller can be simultaneously achieved.

As described above, according to the jam prevention mechanism of the present invention, since the recording sheet can be prevented from being caught around the roller without an excessive resistance applied against the rotation of the roller, jams of the recording sheet can be prevented.

The present disclosure relates to subject matter contained in Japanese patent application No. HEI 02-54163 (filed on Mar. 6, 1990) which is expressly incorporated herein by reference in its entirety.

What is claimed is:

1. A jam prevention mechanism, adapted to be positioned in a device including a pair of rollers through which a sheet is to be fed, for preventing the sheet from being caught around one said pair of rollers, said jam prevention mechanism comprising:

at least one contact member arranged to be located at the downstream side of said pair of rollers along a sheet feeding direction, in contact with a circumferential surface of one of said pair of roller with a predetermined force, said contact member being elastically deformable in such a fashion that it is movable along the sheet feeding direction; and stopper means, provided independently of said contact member, for restricting the movement of said contact member along the sheet-feeding direction elastically deformable extent of the said contact member.

2. The jam prevention mechanism according to claim 1, wherein said contact member comprises a guide spring member made of an elastic material including a pair of pressing portions to be contacted with said one of said pair of rollers by the elastic force of said guide spring member, said guide spring member being mounted on a guide member, and said stopper means comprises a pair of stoppers fixed to said guide member and having stopper portions spaced from the edges of said pair of said pressing portions by a predetermined interval along the sheet feeding direction, respectively.

3. The jam prevention mechanism according to claim 2, wherein said guide member further comprises at least a pair of rib portions, adjacently located with said pair of stoppers, along which the sheet having been fed through said pair of rollers is to be fed.

4. A jam prevention mechanism, adapted to be positioned in a printing device, for executing printing operations on a continuous-form recording sheet by an electrophotographic system, including a pair of fixing rollers, including a heat roller adapted to be heated by a heater member and a press roller arranged to be brought into contact and rotated with said heat roller, through which said continuous-form sheet on which unfixed toner is placed is to be fed, for preventing said continuous-form sheet from being caught around one of said pair of fixing rollers, said jam prevention mechanism comprising:

at least one contact member arranged to be located at the downstream side of said pair of fixing rollers along a feeding direction of said continuous-form sheet and contacted with a circumferential surface of said press roller of said pair of fixing rollers by a predetermined force, said contact member being elastically deformable to be movable along the feeding direction of said continuous-form sheet; and stopper means, provided independently of said contact member, for restricting movement of said contact member along the sheet feeding direction within an elastically deformable extent of said contact member.

5. The jam prevention mechanism according to claim 4, wherein said contact member comprises a guide spring member made of an elastic material and including a pair of pressing portions adapted to be contacted with said press roller by the elastic force of said guide spring member, said guide spring member mounted on a guide member, and said stopper means comprises a pair of stoppers fixed to said guide member and having stopper portions spaced from the edges of said pair of pressing portions by a predetermined interval along the feeding direction of said continuous-form sheet, respectively.

6. The jam prevention mechanism according to claim 5, wherein said guide member further comprises at least a pair of rib portions, adjacently located with said pair of stoppers, along which said continuous-form sheet having been fed through said pair of fixing rollers is to be fed.

7. The jam prevention mechanism according to claim 4, wherein said predetermined heater member comprises a halogen lamp.

8. A jam preventing mechanism for use in an electrophotographic printer device, including a pair of fixing rollers for fixing a latent image on a sheet fed through said pair of fixing rollers, comprising:

prevention means for preventing said sheet from being wrapped around one of said fixing rollers, said prevention means comprising an elastic member contacting an outer surface of one of said fixing rollers with a predetermined force, said elastic member comprising pressing portions that are contacted with said one of said fixing rollers by the elastic force of said elastic member and being movable out of contact with said one of said fixing rollers in the sheet feeding direction.

9. The jam preventing mechanism according to claim 8, further comprising stopper means for restricting the movement of said pressing portions along the sheet feeding direction by a predetermined amount, said stopper means comprising stoppers spaced from the edges of said pressing portions by a predetermined interval along the sheet feeding direction.

10. The jam preventing mechanism according to claim 9, said pair of fixing rollers comprising a heat roller heated by halogen lamp and a press roller rotatably in contact with said heat roller, said prevention means and said stopper means being located at the downstream side of said pair of fixing rollers.

11. The jam preventing mechanism according to claim 10, wherein said one of said fixing rollers contacting said pressing portions is said press roller.

12. The jam preventing mechanism according to claims 8, wherein said one of said fixing rollers contacting said elastic member contacts the surface side of the sheet not containing the latent image.

13. The jam preventing mechanism according to claim 8, wherein said prevention means further comprises sloped ribbed portions aligned along the sheet feeding direction, for guiding the sheet fed through said fixing rollers.

* * * * *

UNITED STATES PATENT AND TRADEMARK OFFICE

CERTIFICATE OF CORRECTION

PATENT NO. : 5,181,076

DATED : January 19, 1993

INVENTOR(S) : T. NISHIKAWA

It is certified that error appears in the above-indentified patent and that said Letters Patent is hereby corrected as shown below:

Column 5, line 32 (claim 1, line 16), delete "the".
Column 6, line 60 (claim 12, line 2), change "claims" to ---claim---.

Signed and Sealed this

Thirtieth Day of August, 1994

Bruce Lehman

*Attest:*

BRUCE LEHMAN

*Attesting Officer*

*Commissioner of Patents and Trademarks*